United States Patent [19]

Yanazawa et al.

[11] Patent Number: 4,685,320

[45] Date of Patent: Aug. 11, 1987

[54] METHOD OF ROLLING STEEL RODS AND WIRES WITH GROOVELESS ROLLS AND GROOVELESS ROLLING ENTRY GUIDE

[75] Inventors: Tadaaki Yanazawa; Teruaki Tanaka; Akio Noda; Ryo Takeda; Masataka Inoue, all of Kurashiki, Japan

[73] Assignee: Kawasaki Steel Corporation, Kobe, Japan

[21] Appl. No.: 918,603

[22] Filed: Oct. 10, 1986

Related U.S. Application Data

[63] Continuation of Ser. No. 662,549, Oct. 19, 1984, abandoned, which is a continuation of Ser. No. 378,110, May 14, 1982, abandoned.

[30] Foreign Application Priority Data

Aug. 5, 1981 [JP] Japan ..... 56-122604
Oct. 31, 1981 [JP] Japan ..... 56-173704

[51] Int. Cl.[4] ..... B21B 1/18; B21B 39/10

[52] U.S. Cl. ..... 72/250; 72/235; 72/366

[58] Field of Search ..... 72/234, 235, 240, 248, 72/250, 365, 366

[56] References Cited

U.S. PATENT DOCUMENTS

| | | | |
|---|---|---|---|
| 859,390 | 7/1907 | Koziel et al. | 72/250 |
| 3,186,207 | 6/1965 | Schmitt | 72/250 |
| 3,620,063 | 11/1971 | Kursinczky | 72/250 |
| 3,661,006 | 5/1972 | Massara | 72/250 |
| 3,776,013 | 12/1973 | Groh et al. | 72/250 |
| 3,837,207 | 9/1974 | Tarmann | 72/366 |
| 4,007,617 | 2/1977 | Falk et al. | 72/366 |
| 4,050,280 | 9/1977 | Sayer | 72/234 |
| 4,070,893 | 1/1978 | Nishikubo | 72/234 |
| 4,394,822 | 7/1983 | Simons | 72/366 |

*Primary Examiner*—Robert L. Spruill
*Assistant Examiner*—Steve Katz
*Attorney, Agent, or Firm*—Balogh, Osann, Kramer, Dvorak, Genova & Traub

[57] ABSTRACT

A method of rolling steel rods or wires by grooveless rolls for reducing sectional areas of the rods or wires and achieving a stable rolling operation with high efficiency by limiting to less than a predetermined value the ratio of a long side to a short side of a cross-section of a blank material (having a rectangular cross-section) which has passed through each pair of grooveless rolls or limiting the ratio of the diameter of each pair of grooveless rolls to the gap therebetween. The method of rolling steel rods or wires by grooveless rolls also achieves high elongation efficiency to make stable the rolling operation by limiting the ratio of the diameter of each pair of grooveless rolls to the gap therebetween. The method uses a grooveless roll entry guide in the grooveless rolling so as to securely hold a blank material from entry to exit in a gap between the pair of grooveless rolls to eliminate overturns at the ends of the blank material and fins extending from the material due to the overturns.

3 Claims, 34 Drawing Figures

METHOD OF ROLLING STEEL RODS AND WIRES WITH GROOVELESS ROLLS AND GROOVELESS ROLLING ENTRY GUIDE

This application is a continuation of application Ser. No. 662,549, filed Oct. 19, 1984 now abandoned, which in turn is a continuation of Ser. No. 378,110, filed May 14, 1982, now abandoned.

BACKGROUND OF THE INVENTION

1. Field of the Invention

This invention relates to a method of rolling steel rods and wires with grooveless rolls, including entry guides for holding a blank material in the gap between the rolls.

2. Description of the Prior Art

The term "steel rods and wires" used herein is intended to designate elongated square, rectangular or circular cross-sectional rods and wires of steel and non-ferrous materials.

The term "grooveless roll" or "caliberless roll" used herein means a roll which is not formed with a caliber or calibers in its barrel.

In rolling blank materials having square cross-sections to produce steel rods, wires or the like having rectangular or circular cross-sections, pairs of caliber rolls have hitherto been exclusively used. FIG. 1 of the accompanying drawings, illustrates a typical pass schedule, wherein, a blank material w having a square cross-section is rolled through square and parallelogram calibers s and d one or more times and thereafter rolled through calibers having substantially the same sectional shapes as the above to obtain square cross-sectional steel products p or alternately through oval and round calibers o and r to obtain circular cross-sectional steel products p'. In these cases, the material is generally subjected to continuous rolling wherein it passes through the rolls of a continuous series of rolling mills $M_1$, $M_2$, $M_3$, . . . $M_n$ as shown in FIG. 2 (of the drawings).

When carrying out rolling operations with a continuous series of rolling mills including pairs of caliber rolls, the number of roll stands required for the reduction of the material is determined by dimensions of ultimate products and cross-sections of the blank materials. In the case where circular cross-sectional rods having an outer diameter of 20 mm are to be produced from blank materials of a square section having sides of 145 mm, for example, there are required six roughing, intermediate and finishing roll stands, respectively, which include pairs of rolls having calibers as shown in FIG. 1. Such rolling operations with caliber rolls will involve the following problems.

(1) When the rolls of a pair of caliber rolls are shifted from their alignment positions or the caliber roll centers and the centers of guide means for introducing materials to be rolled into the caliber rolls are shifted with respect to each other, protrusions in the form of fins in the longitudinal direction will occur on the materials delivered from the caliber rolls. These fins will collapse during the next rolling operations to cause defects such as overlaps on the surfaces of the rods.

(2) In order to avoid the above defects, it is necessary to set the rolls and guide means with high accuracy and this requires a long down time.

(3) The accuracy of the dimension and the shape of the caliber rolls directly affects the quality of the product to a great extent so that highly complex and highly expensive roll lathes are required to machine the caliber rolls.

(4) Differences in circumferential speed between the respective rolls of the pairs of caliber rolls give rise to frictional irregular wear, so that the rolls must be machined many times to correct the calibers with resulting increased cost.

(5) If the size of rods to be rolled is changed (for example, from a 16 mm outer diameter of circular cross-sectional rods to a 40 mm outer diameter rod, many caliber rolls must be changed and this increases the down time of the rolling mills. It is impossible to use a pair of caliber rolls over a wide range of sizes of rods to be rolled.

(6) If the gap between a pair of caliber rolls is unintentionally made smaller than a predetermined value, protrusions occur on the surfaces of the rolled materials, which collapse during the next rolling operations to form defects such as overlaps on the surfaces.

In order to avoid the above disadvantages of caliber rolling, a rolling method using caliberless rolls has recently been proposed wherein the blank materials are rolled by caliberless rolls mainly for the purpose of reducing the cross-sectional areas of the rods and these are then further rolled by caliber rolls for obtaining the ultimate shape of the products. FIG. 3 of the drawings, illustrates a basic pass schedule for this method, in which the caliberless rolls are used in upstream passes u and intermediate passes m immediately before the forming passes f and caliber rolls are used in the forming passes f.

When caliberless rolls are substituted for caliber rolls, the machining of the calibers is naturally not required and the damage and wear on the surfaces of the caliberless rolls are less than in the case of caliber rolls. Thus the life of the rolls is longer resulting in lower cost. Also, shorter down time is required, because a change of rolls is not required even if the shapes and sizes of the products to be rolled are changed. However, the caliberless rolls have the following disadvantages.

(1) Caliberless rolls do not restrain the materials in the width direction thereof because they do not have calibers. Thus elongation of the materials in the rolling direction is less than in the case of caliber rolls. In order to obtain elongation of the materials in the rolling direction substantially equivalent to that obtained with caliber rolls, the reductions must be increased. The increased reduction however, makes the flat ratio larger, which is defined as $B_o/H_o$ shown in FIG. 4 of the drawings. Because of the excess flat ratio, the cross-section of the material is incorrectly deformed in the next caliberless roll pass as shown in FIG. 4, so that the overturn a/H increases depending upon the flat ratio $B_o/H_o$, which makes it impossible to continue the rolling operation.

(2) When the reduction is comparatively large, the free surfaces of the materials which are not in contact with the rolls bulge as shown in FIG. 5 of the drawings. If the bulge ratio which is defined as $b/H_o$ is too large, the overturn a/H becomes large which makes it impossible to effect the next rolling.

(3) When an existing rolling installation is changed from caliber rolling to caliberless rolling, the number of passes must be increased because of the reduced elongation of the material in the rolling direction. This decreases the productivity of the installation and in turn leads to an increase in the number of roll stands in continuous rolling mills.

SUMMARY OF THE INVENTION

It is an object of the invention to provide an improved method of rolling steel rods and wires using grooveless rolls in rolling processes for reducing the sectional areas of rods and wires for obtaining final profiles of the rods and wires (limiting the ratio of a long side to a short side of the cross-section of blank material having a rectangular cross-section blank material through each pass) and achieving stable rolling by the grooveless rolls.

It is another object of the invention to provide a method of rolling steel rods and wires by grooveless rolls limiting the ratio of the diameter of each pair of grooveless rolls to a gap therebetween according to the gap, thereby achieving high elongation efficiency required to make stable the rolling operation.

It is a further object of the invention to provide a grooveless roll entry guide for use in the improved method. The grooveless roll entry guide securely holds a blank material from an entry to an exit in a roll gap so as to eliminate the difficulties discussed above occurring at ends of the blank material which are inherent in rolling by grooveless rolls.

The invention will be more fully understood by referring to the following detailed specification and claims taken in connection with the appended drawings.

DETAILED DESCRIPTION OF THE PREFERRED EMBODIMENT

Figure 1:
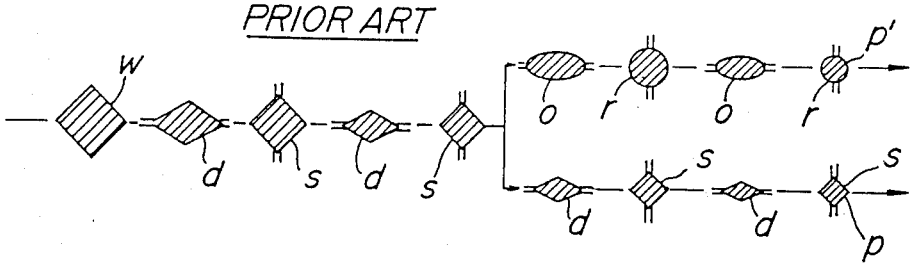
FIG. 1 PRIOR ART
FIG. 1 is a schematic illustration of the use of various caliber rolls in steel rod rolling in accordance with the prior art.
Figure 2:
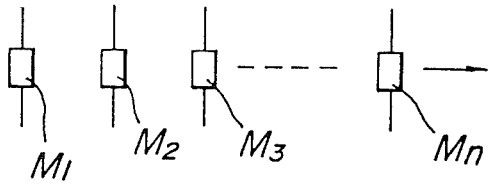
FIG. 2 PRIOR ART
FIG. 2 schematically illustrates a series of rolling mills for caliber rolling steel rods in accordance with the prior art.
Figure 3:
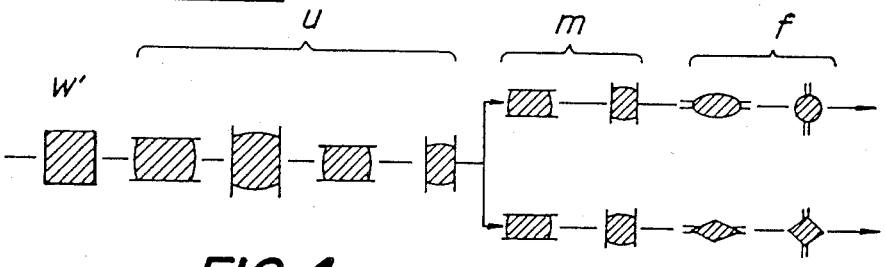
FIG. 3 PRIOR ART
FIG. 3 schematically shows pass schedules for rolling steel rods or wires with caliber rolls and caliberless rolls in accordance with the prior art.
Figure 4:
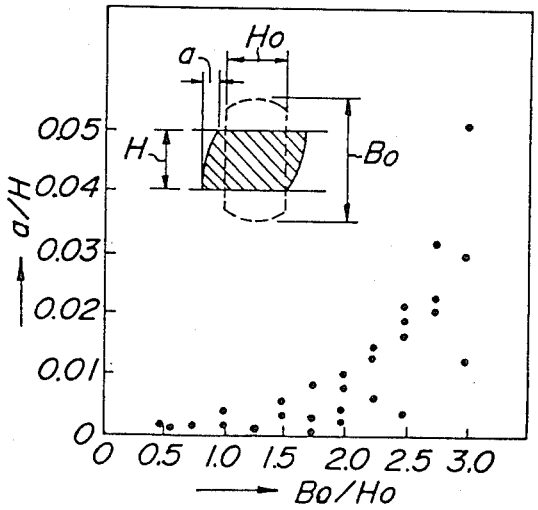
FIG. 4 is of the flat ratio ($B_o/H_o$) as abscissa against overturn (a/H) as ordinate when rolling (using) caliberless rolls.
Figure 5:
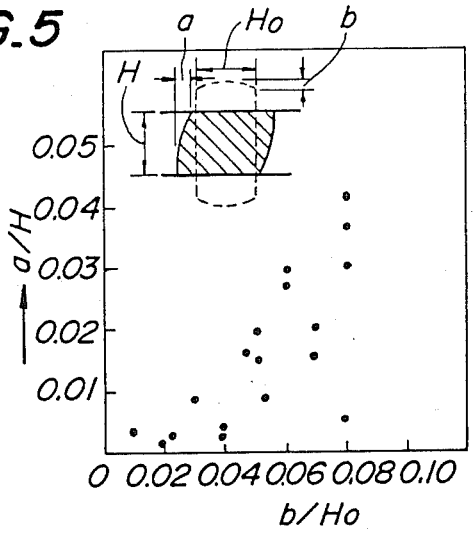
FIG. 5 is a graph of the bulge ratio ($b/H_o$) as abscissa against overturn (a/H) as ordinate when rolling (using) caliberless rolls.
Figure 6:
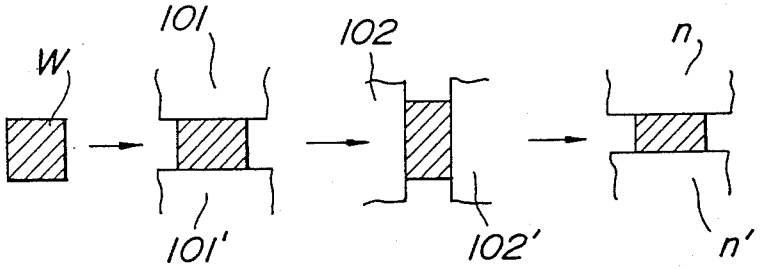
FIG. 6 is a schematic elevation showing the rolling of a blank material using caliberless rolls.
Figure 7:
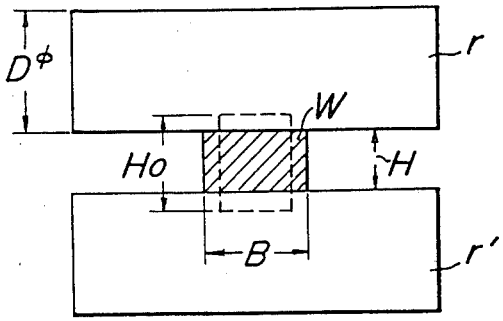
FIG. 7 is a schematic cross-section illustrating dimensions for calculating the aspect ratios of blank materials immediately afer being rolled, using caliberless rolls.
Figure 8:
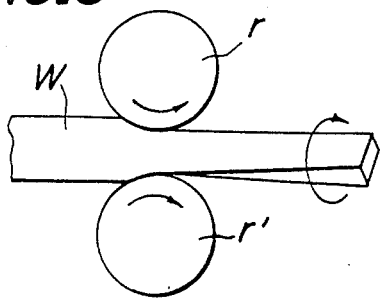
FIG. 8 is a side view illustrating the occurrence of twisting of the blank material, when rolling (using) caliberless rolls.
Figure 9:
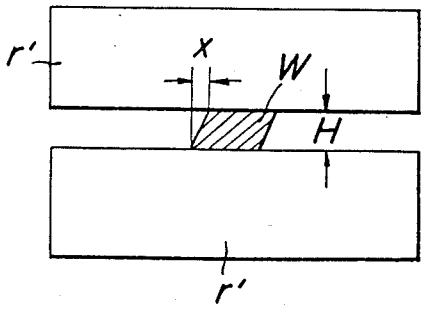
FIG. 9 is a schematic cross-section illustrating the occurrence of overturn of the blank material, when rolling (using) caliberless rolls.

Referring now to FIG. 6, a blank material W which may be in the form of a bloom or billet and have, for example, a square cross-section is continuously rolled through pairs of caliberless rolls 101, 101', 102, 102', . . . , n and n' to reduce the cross-sectional area so as to obtain a rolled product having a required cross-sectional shape. It has been found that if the roll gap between a pair of grooveless rolls r and r' is so adjusted that the reduction of the material is too large or the aspect ratio B/H is more than 1.5 where B and H are the long side and the short side perpendicular thereto of a cross-section of the material W delivered from the rolls (as shown in FIG. 7), twisting and overturn of the material occur in the next reduction pass as shown in FIGS.

8 and 9. These tendencies increase multiplicatively as the number of passes increases, until the rolling operation becomes impossible.

According to the present invention, the roll gap between each pair of grooveless rolls r and r' in continuous pass rolling is so adjusted that the aspect ratio B/H of the material delivered from the gap of the rolls r and r' is less than 1.5 to achieve stable rolling without twisting and overturn of the material.

Figure 10:
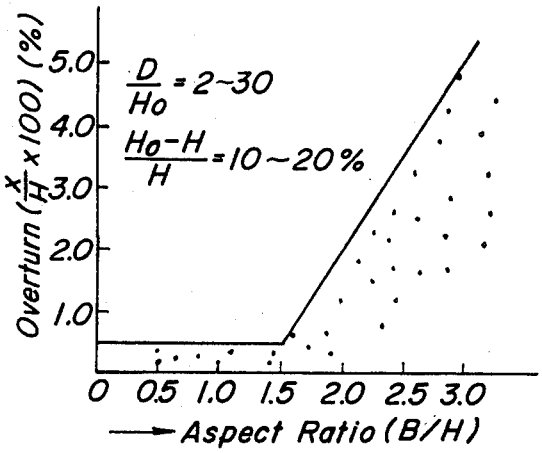
FIG. 10 is a graph of aspect ration (B/H) as abscissa and overturn ($\times/H\times100$) as ordinate when rolling blank materials using caliberless rolls.

FIG. 10 illustrates relations between the aspect ratio B/H and the overturn $(x/H)\times 100\%$ when the gaps between pairs of grooveless rolls are changed. As shown in this graph, when $B/H \geqq 1.5$, the overturn increases greatly and twisting often occurs before the next roll stand, so that the material tends to collide against the guides at the entry side of the next roll pair resulting in a miss roll. When the overturn is more excessive, the cross-sectional shape will be more incorrectly deformed in the next rolling to make it impossible to effect the continuous rolling.

In contrast therewith, when $B/H < 1.5$, the overturn is less than 0.5% and continuous pass rolling can be stably carried out without any noticeable twisting. In view of this, the aspect ratio of the rolled material immediately after passing through a pair of rolls is limited to less than 1.5 according to the present invention.

Figure 11:
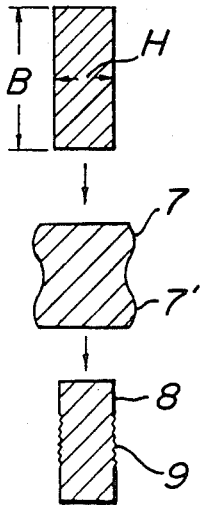
FIG. 11 is a schematic cross-section of a blank material explaining the formation of a double barrel configuration on the surface during caliberless rolling.
Figure 12:
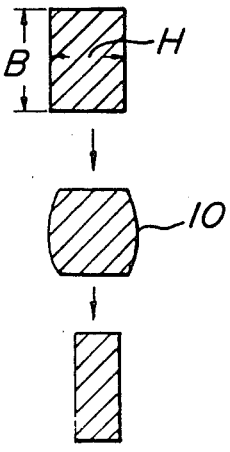
FIG. 12 is a schematic cross-section of a blank material explaining formation of a single barrel configuration on the surface during caliberless rolling.

Moreover, when the aspect ratio B/H is much larger than 1.5, the cross-sectional shape of the rolled material after each rolling pass is apt to be in the form of a double barrel configuration (7 and 7') which cause wrinkles 9 on a surface 8 in the next rolling as shown in FIG. 11. On the contrary, when the aspect ratio B/H is less than 1.5, the cross-section is in the form of a single barrel configuration (10) which does not cause wrinkles on the face in the next rolling as shown in FIG. 12.

It is of course understood that in order to obtain ultimate square and circular cross-sectional rods, the materials subjected to the above reduction with the grooveless rolls to give them predetermined sections are then rolled through the box, oval or round-shaped calibers of caliber rolls in a conventional manner.

Figure 13:
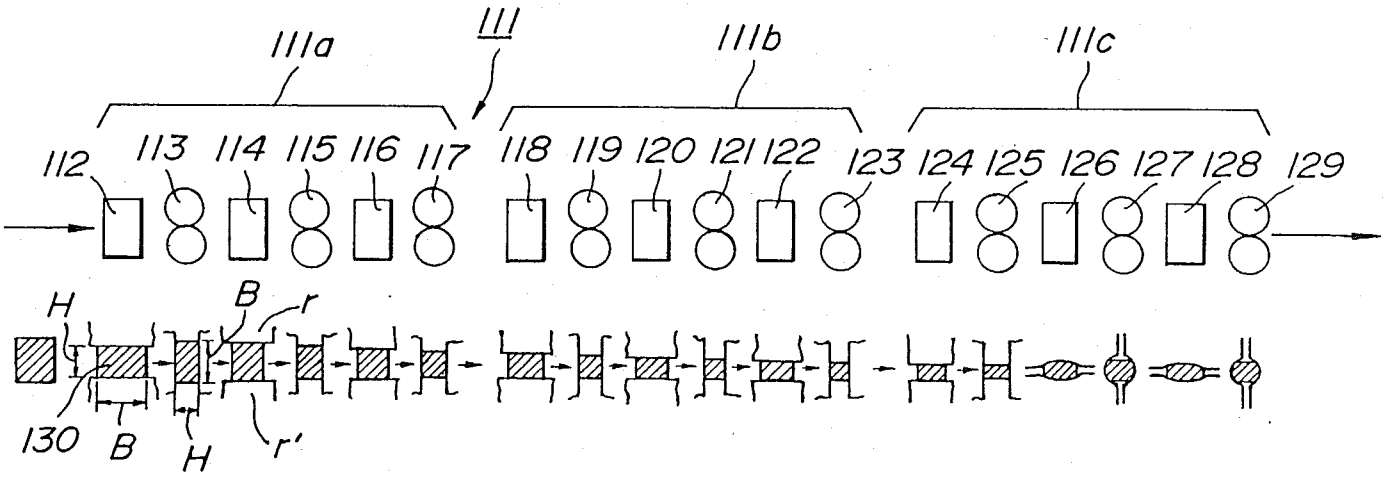
FIG. 13 is an explanatory view illustrating a series of continuous rolling mills.

FIG. 13 illustrates a preferred example of a series of rolling mills for use in carrying out the present invention. The series of the rolling mills 111 consists of a roughing mill 111*a*, an intermediate mill 111*b* and a finishing mill 111*c*. The roughing mill 111*a* includes horizontal rolls 112, 114 and 116 and vertical rolls 113, 115 and 117. The intermediate mill 111*b* includes horizontal rolls 118, 120, and 122 and vertical rolls 119, 121 and 123. The finishing mill 111*c* includes horizontal rolls 124, 126 and 128 and vertical rolls 125, 127 and 129. The rolls 112–125 are all grooveless rolls, while the four pairs of rolls 126–129 on the downstream sides are caliber rolls for obtaining round steel rods from square cross-sectional rods. In the case where the ultimate products are to be of square cross-section, the caliber rolls are not needed.

Shaded sections 130 are cross-sections of the material immediately after having passed through the respective pairs of rolls, all the aspect ratios of which are less than 1.5 by suitably setting the roll gaps. Although the horizontal and vertical roll pairs are alternately arranged in the series of rolling mills shown in FIG. 13, these roll pairs may be arranged in a different manner and twisting devices may be arranged between the horizontal rolling mills for rotating the materials to be rolled through 90° about their axes.

FIG. 13 clearly illustrates that the number of passes of the cross-sections of the material through the respective pairs of the grooveless rolls, wherein the aspect ratio is less than 1.5, is more than 30% of the total number of grooveless rolling passes.

As shown in this Figure, there are a total of 14 grooveless rolling passes (excluding four caliber rolling passes). Among the 14 passes, the ratio is less than 1.5 in more than 5 passes. That is more than 30% with respect to the 14 passes.

Figure 14:
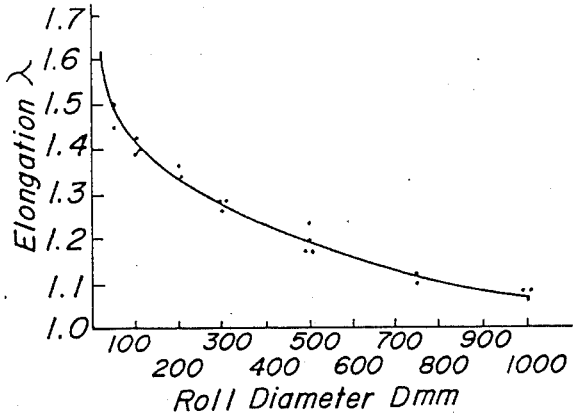
FIG. 14 is a graph of caliberless roll diameter as abscissa and the elongation of material rolled by the roll as ordinate.

In order to eliminate the disadvantages in rolling with grooveless rolls mentioned in the preamble of this specification, the inventors investigated the behavior of steel rods in grooveless roll passes by means of many experiments and found that the elongations of the steel rods subjected to rolling by grooveless rolls greatly depend upon the diameters of the rolls. FIG. 14 illustrates one example of the results of experiments, wherein $20\times 20$ mm square blank materials which were subjected to reduction of 8 mm using grooveless rolls of various diameters D and the elongations $\lambda$ of the materials were noted. As can be seen from FIG. 14, the smaller the diameters of the grooveless rolls, the larger was the elongation.

Figure 15:
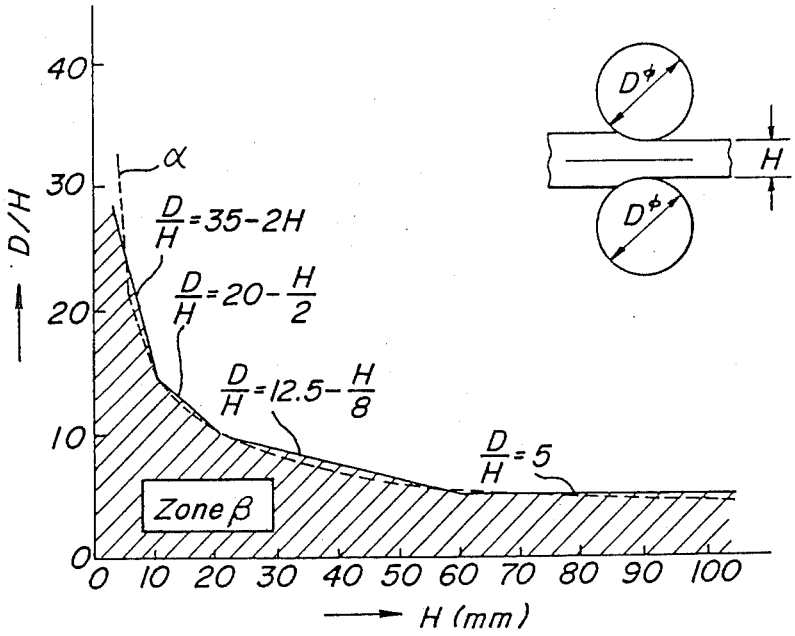
FIG. 15 is a graph of caliberless roll gap H as abscissa and D/H as ordinate where D is the roll diameter.

The elongation $\lambda$ is the ratio of the length of the material after having been rolled to the length before being rolled. An elongation efficiency $\eta$ is then defined as the ratio of such an actual elongation $\lambda$ to an ideal elongation $\lambda'$ obtained by assuming that the material was elongated only in the rolling direction without being widened perpendicularly to the rolling direction. The inventors continued their experiments into grooveless rolling to ascertain the conditions required for obtaining an elongation efficiency equivalent to or greater than that obtained when caliber rolling. As the result, it was found that high elongation efficiency is obtained with grooveless rolls under the rolling condition zone $\beta$ shaded in FIG. 15 which illustrates the relationship between the grooveless roll diameter D and the ratio D/H where H is the roll gap. This zone $\beta$ is expressed by the following formula.

$$D/H \leqq (100/H)+5$$

Values D/H can be easily calculated approximately along respective diagonal lines as follows:

when $H \geqq 60$ mm, $D/H \leqq 5$, when 60 m$>H \geqq 20$ mm, $D/H \leqq 12.5-(H/8)$, when 20 mm$>H \geqq 10$ mm, $D/H \leqq 20-(H/2)$, and when $H<10$ mm, $D/H \leqq 35-2H$.

As can be seen from the values of the ratios D/H, the diameters D must be much smaller than the 360 mm$\phi$ of the hitherto used caliberless or grooveless rolls, so that it is preferable to use back up rolls to give support against the rolling reaction forces in order to compensate for the lack of rigidity of the small diameter grooveless rolls. However, the back up rolls can be easily provided by those skilled in the art of multiple roll mills.

The use of grooveless rolls within the zone $\beta$ according to the present invention achieves a high elongation efficiency which means that the ratio of the effective energy consumed to elongate or reduce the cross-section of the material to the total energy for rolling is high, whilst the ratio of superfluous energy consumed in the widening of the material is small. Thus the present invention is also advantageous from the viewpoint of energy conservation. In this manner, the present invention enables stable rolling using grooveless rolls to be carried out by effectively restraining the widening of the material being rolled.

Figure 16A:
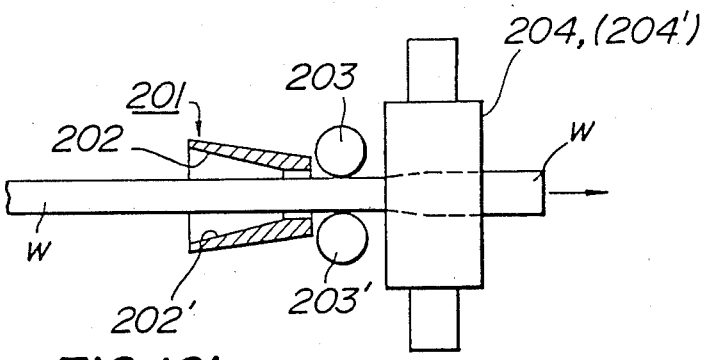
FIG. 16a PRIOR ART
FIGS. 16*a* and 16*b* are explanatory side elevations illustrating a conventional entry guide for guiding blank material when conventional rolling is carried out with caliber rolls and caliberless rolls.
Figure 16B:
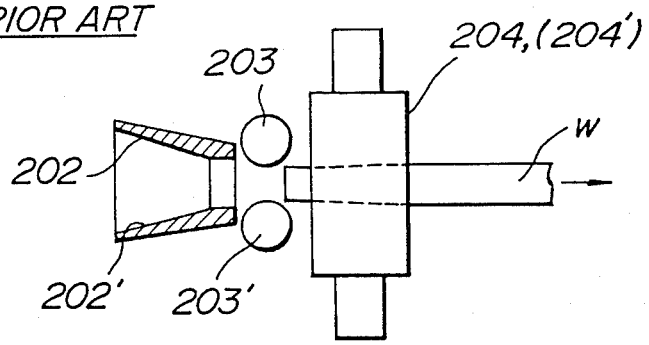
FIG. 16b PRIOR ART
Figure 17:
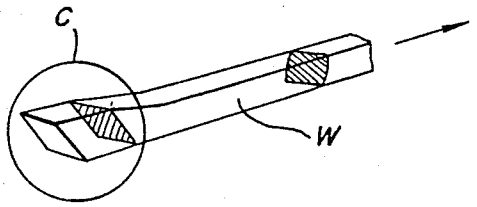
FIG. 17 is a perspective view showing a defect at the tail end of a blank material, using the entry guide of FIGS. 16*a* and 16*b;*

When caliberless rolling, in accordance with the present invention, it is preferred to use special entry guides for correctly introducing materials to be rolled into the roll gaps in a similar manner as in caliber rolling. As is shown in FIG. 16, in conventional caliberless rolling the material w to be rolled is fed into the gap of the caliberless rolls 204 and 204', while it is guided by the guide plates 202 and 202' of an entry guide 201 and maintained in position by guide rollers 203 and 203'. In this case, so long as the material w is held by the guide rollers 203 and 203' as shown in FIG. 16*a*, an overturn of the material w does not occur. However, as soon as the tail end of the material leaves the guide rollers 203 and 203' as shown in FIG. 16*b*, the material is no longer held and overturn is apt to occur, whereby the cross-section of the tail end c changes to a parallelogram shape as shown in FIG. 17. The larger the flat ratio $B_o/H_o$ and bulge ratio $b/H_o$ of the material, the acuter is the overturn and it may be impossible to effect the desired rolling processes.

Figure 18:
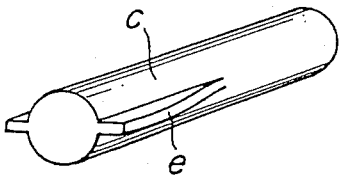
FIG. 18 is a perspective view of a rod having fins due to the defect shown in FIG. 17.
Figure 19:
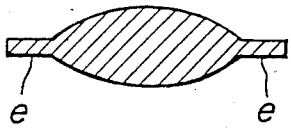
FIG. 19 is a sectional view of the rod showing the adverse effect of the defect when caliber rolling.

As shown in FIG. 18 fins e occur on the tail end of a product which has been subjected to a forming pass, in conventional rolling, and these must be removed in an extra process. When such fins e become excessive, the fins will be subjected to rolling in a small gap other than the calibers, and this will cause an extraordinarily large rolling load resulting in stoppage and damage of the rolling mill. If the overturn becomes excessive, the sectional size becomes larger than a predetermined value, so that the material cannot pass through the entry and exit guides of the rolls, causing stoppage of the mill and breakage of the guides.

In order to avoid such disadvantages which are inherent in the caliberless rolling an entry guide used when rolling in accordance with the present invention, which supports the material to be rolled until it leaves the grooveless roll gap to mitigate overturn which would otherwise be apt to occur on the tail end of the material, and to prevent the above-mentioned improved productivity, owing to the high elongation efficiency, from being lowered due to the decreased yield rate resulting from the removal of crops on the tail ends of the rolled materials.

Figure 20:
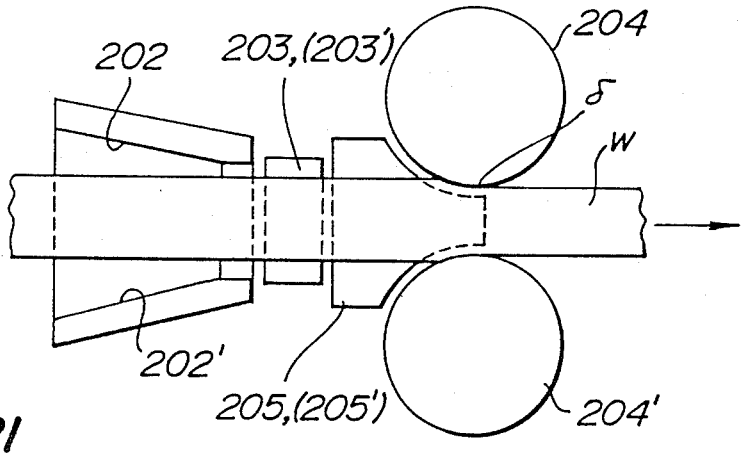
FIG. 20 is a vertical sectional view perpendicular to axes of the rolls illustrating the basic constitution of an entry guide for use in the method according to the present invention.
Figure 21:
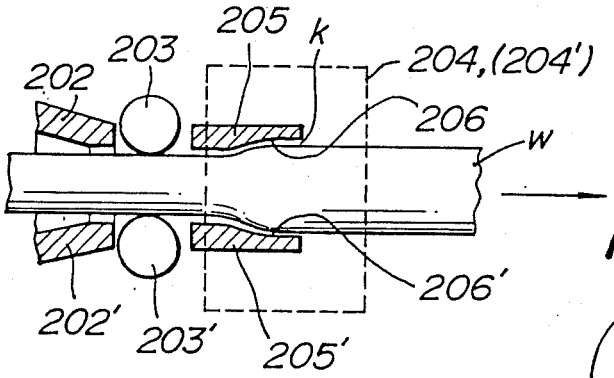
FIG. 21 is a horizontal view in a plane parallel to that of axes of the rolls of the entry guide shown in FIG. 20.

FIGS. 20 and 21 are explanatory views illustrating the fundamental construction of an entry guide, used in accordance with one embodiment of the method of the present invention. As shown in the drawings, the entry guide includes guide plates 202 and 202' and guide rollers 203 and 203' as in the prior art construction shown in FIGS. 16*a* and 16*b*. In addition the guide entry includes bill-like projections 205 and 205' arranged between the guide rollers 203 and 203' and grooveless rolling rolls 204 and 204' and extending through the gap between the grooveless rolls 204 and 204' at least to the exit δ, or beyond an imaginary line connecting the centers of the grooveless rolls, where the deformation of the material being rolled is completed, so as to embrace and support the material in the axial direction of the rolling rolls. Although a pair of guide rollers 203 and 203' have been shown in the drawings, in the case of a roughing stand operating at relatively low rolling speeds two pairs of guide rollers are preferably provided to enhance the holding of the material and in addition thereto, a guide roller or guide rollers are preferably provided on the exit side.

The material w to be rolled is naturally deformed along the axial direction of the grooveless rolls during rolling. In other words, the deformation of the material w advances in streamlines in the axial direction of the rolls to widen its width from the beginning to the termination of rolling as shown in FIG. 21. The shape of the deformation can be roughly anticipated. Accordingly, the bill-like projections 205 and 205' have inner relief surfaces 206 and 206' substantially corresponding to the transition of deformation of the material in the axial direction of the grooveless rolls. The relief surfaces 206 and 206' are set so as to obtain the optimum clearances k between the surfaces and the material to be rolled. When the clearance k is less than 1 mm, the side surfaces of the material to be rolled are apt to contact the relief surfaces 206 and 206' and this causes scratches in the surfaces of the material. On the other hand, when the clearance k is as much as more than 5 mm, the projections 205 and 205' do not serve to restrain the material and therefore do not prevent the overturn of the material. Accordingly, the clearance k is preferably 1–5 mm for preventing the overturn over the length of the material and to thereby allow a stable rolling operation to be carried out by the grooveless rolls.

Figure 22:
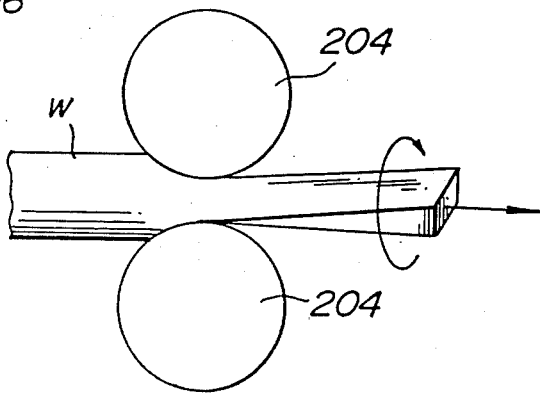
FIG. 22 is a side view of blank material passing through rolls showing twisting of the leading end of the rolled blank material.

The bill-like projections 205 and 205' also serve to guide the leading end of the material w into the roll gap. When the material is guided only by the guide rolls 203 and 203' without the bill-like projections, the leading end of the rolled material w delivered from the roll gap twists about its axis (see FIG. 22), which makes it impossible to introduce the material into the next roll stand. Such a rolling problem can be eliminated by the bill-like projections.

Figure 23A:
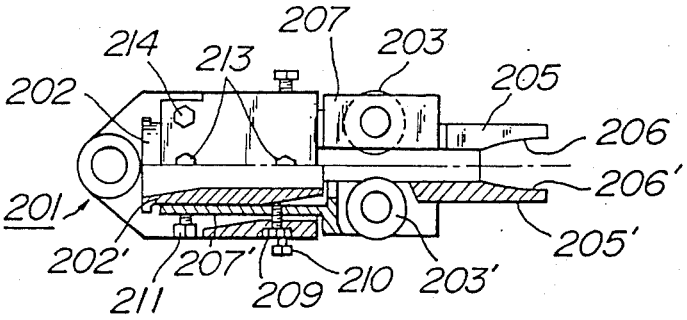
FIGS. 23*a* and 23*b* are plan and side views of an embodiment of an entry guide for use in the method according to the present invention.
Figure 23B:
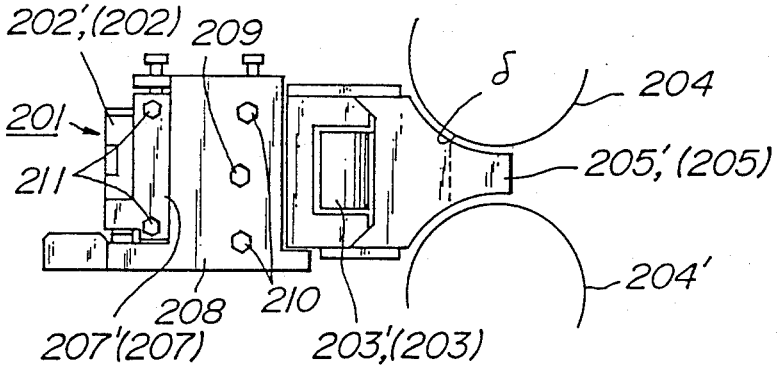
Figure 24:
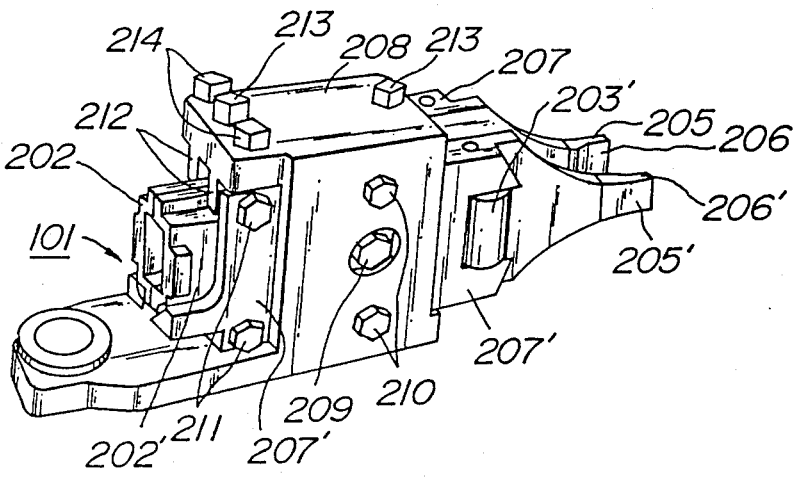
FIG. 24 is a perspective view of the entry guide shown in FIGS. 23*a* and 23*b;*
Figure 25:
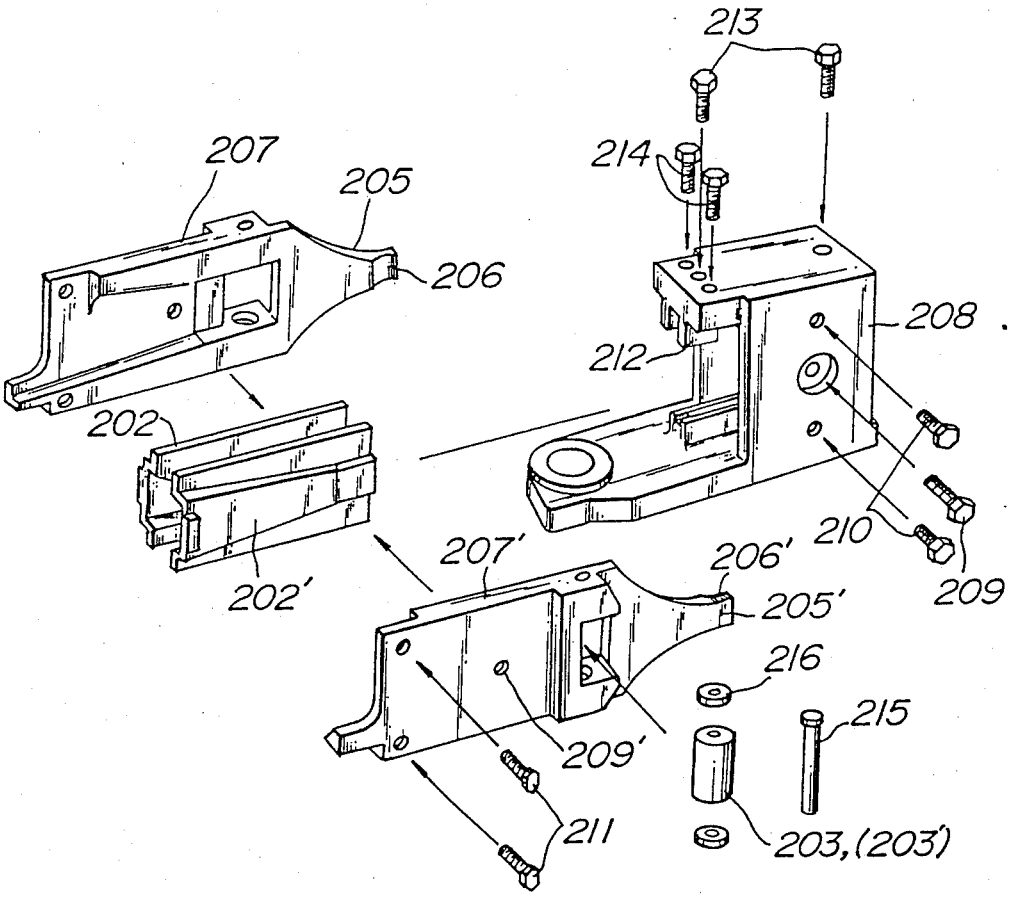
FIG. 25 is an exploded perspective view of the entry guide shown in FIG. 24.

FIGS. 23*a* and 23*b* are a plan and a side view of an actual embodiment of such an entry guide 201 which may be used according to the rolling method of the present invention applied to horizontal grooveless rolls 204 and 204' the important parts being shown in section. FIG. 24 is a perspective view of the entry guide 201 and FIG. 25 is an exploded perspective view thereof. Relating to FIGS. 23*a*, 23*b*, 24 and 25, the entry guide 201 comprises guide plates 202 and 202' mating with each other and having respective inner taper surfaces, and a pair of holders 207 and 207' embracing the guide plates 202 and 202' and including guide rollers 203 and 203' supporting the sides of the material w next to the front ends of the taper surfaces of the guide plates 202 and 202'. The entry guide also includes a box-shaped guide 208 housing therein the assembly of the guide plates 202 and 202' and holders 207 and 207' and adjustably fixing the guide rollers 203 and 203'. The holders 207 and 207' are retained by retaining bolts 209 passing through the sidewalls of the box-shaped guide 208 and screwed into threaded holes 209' formed in the holders. Adjusting set screws 210 are screwed into the sidewalls of the box-shaped guide 208 to adjustably set the distance between the holders 207 and 207'. Adjusting set screws 211 are screwed into the holders 207 and 207' to abut against reaction plates 212 with the aid of which the set screws 211 set the clearances of the guide rollers 203 and 203'. Set screws 213 and 214 are screwed into an upper wall of the box-shaped guide 208 to fix the guide plates 202 and 202' and holders 207 and 207'. The adjustable guide rollers (203 and 203') are rotatably supported on pins 215 through bearings 216. In this embodiment, although the bill-like projections 205 and 205' extending in the gap of the grooveless rolls 204 and 204' to the exit have been shown integrally with the holders 207 and 207' at their ends, the bill-like projections may be formed separately from and fixed to the holders 207 and 207' by welding or by set screws.

Figure 26A:
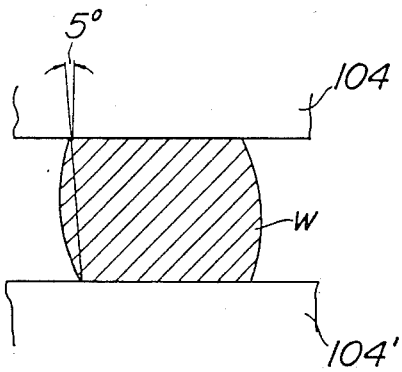
FIG. 26*a* is a sectional view of blank material being rolled in accordance with present invention and showing the small overturn angle obtained.
Figure 26B:
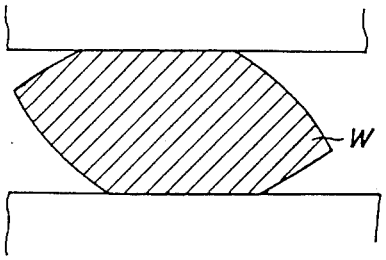
FIG. 26*b* is a sectional view of blank material being rolled in accordance with the prior art and showing the large overturn angle obtained.
Figure 27:
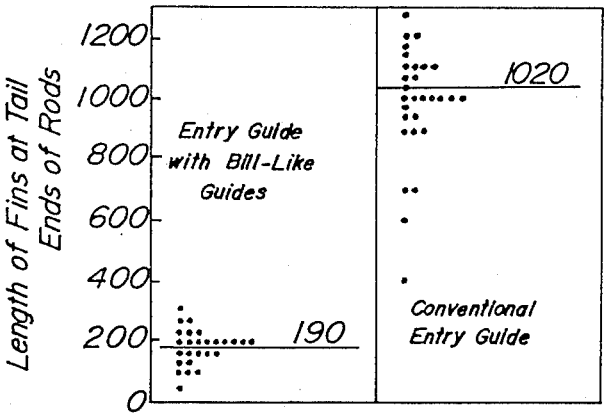
FIG. 27 is a schematic comparison of the fin lengths at the tail end of rods produced using an entry guide according to the present invention with those of rods produced using a conventional guide.

A blank material of 150 mm square was rolled in accordance with the method of the present invention using grooveless rolls with above entry guides 201. 12 passes were carried out and the material was then passed six times through caliber rolls to obtain round steel rods of 16 mm diameter. On the other hand, by way of comparison, similar blank material was rolled in the same manner but using conventional entry guides having guide rollers 203 and 203' but having no bill-like projections 205 and 205'. The overturn of the tail ends of the rolled materials, were compared when the clearances k between the material and the relief surfaces 206 and 206' of the bill-like projections 205 and 205' were 3–5 mm, the overturn angles at the tail ends of the material were within 5° as shown in FIG. 26*a* which angles did not impede the following caliber rolling. However, while using the conventional entry guides considerable overturns at the tail ends of the material occurred (see FIG. 27*b*) so that one third of the test rods would not pass through the entry guides of the subsequent mills. Although it was not impossible to roll the remaining two thirds to 16 mm diameter rods, the lengths of the fins formed on the tail ends were more than five times the lengths of the fins formed on the tail ends of the materials rolled using entry guides having the bill-like projections, and thus, the yield rate was lowered considerably as shown in FIG. 27.

Figure 28:
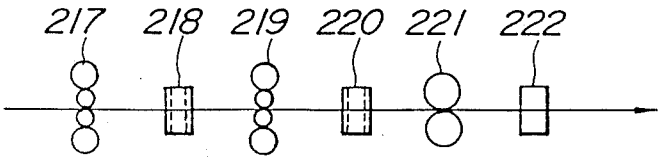
FIG. 28 is a plan view of one example of a series of rolling mills for carrying out a rolling method according to the present invention.

Entry guides including bill-like projections were used when rolling small diameter steel rods and wires, for which entry guides are important to improve the yield rate in accordance with the method of the present invention. Use was made of a continuous finishing tandem rolling mill apparatus consisting of six horizontal and vertical mills alternately arranged, that is, four sets of four high mills 217, 218, 219 and 220 including back up rolls for four upstream passes and two sets of two high mills 221 and 222 for two downstream passes (see FIG. 28). A blank material of 18 mm square was progressively rolled according to the pass schedule shown in FIG. 29 to produce 11 mm diameter round steel rods.

In contrast herewith, with conventional all caliber rolling (see FIG. 30), although it was possible to roll the 18 mm square blank material to 11 mm round rods by means of six passes through alternate oval and round calibers, the rolling encountered the above mentioned disadvantages. Moreover, in the case where the 18 mm square blank rods were rolled to 11 mm round rods by means of four upstream passes using two high mills including grooveless rolls according to a conventional method and remaining two upstream passes through caliber rolls (see FIG. 31), the rods rolled through the grooveless rolls were excessively flattened and the rolling was unstable. This was due to the fact that the roll diameters of the two high mills were comparatively large such as 360 mm, so that the ratio D/H was also large and this considerably reduced the elongation efficiency, in other words, produced superfluous widening of the material in width. The following table shows the considerable difference in elongation efficiency between the pass schedule of the prior art (FIG. 31) and that according to the method of the present invention, (FIG. 29).

TABLE

Figure 29:
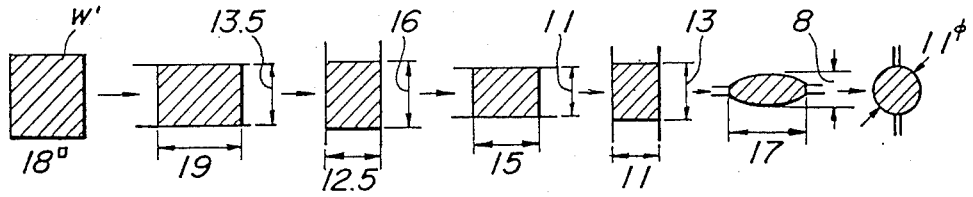
FIG. 29 illustrates a pass schedule for a rolling method according to the present invention.
Figure 30:
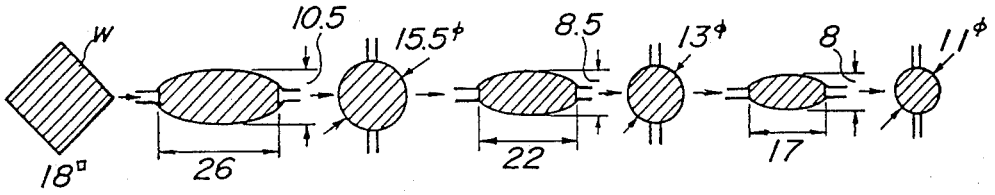
FIG. 30 shows a pass schedule for conventional caliber rolling.
Figure 31:
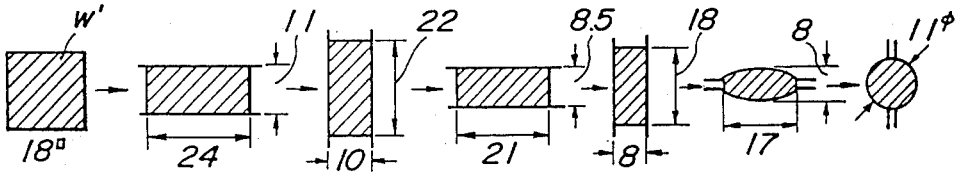
FIG. 31 illustrates a pass schedule for caliberless rolling of the prior art.

| | FIG. 31 (Prior art) | | | | | FIG. 29 (According to the invention) | | | | |
|---|---|---|---|---|---|---|---|---|---|---|
| Pass No. | Roll diameter (mm) | Roll gap (mm) | Reduction (%) | Elongation | Elongation efficiency | Roll diameter (mm) | Roll gap (mm) | Reduction (%) | Elongation | Elongation efficiency |
| 0 | | 18□ | | | | | 18□ | | | |
| 1 | 360 | 11 | 39 | 1.23 | 0.75 | 100 | 13.5 | 25 | 1.26 | 0.95 |
| 2 | " | 10 | 58 | 1.20 | 0.50 | " | 12.5 | 34 | 1.28 | 0.84 |
| 3 | " | 8.5 | 61 | 1.23 | 0.48 | " | 11 | 31 | 1.21 | 0.83 |
| 4 | " | 8 | 62 | 1.24 | 0.47 | " | 11 | 27 | 1.15 | 0.85 |
| 5 | " | 8 | 56 | 1.31 | 0.52 | 360 | 8 | 38 | 1.30 | 0.68 |
| 6 | " | 11ϕ | 35 | 1.13 | 0.87 | " | 11ϕ | 35 | 1.13 | 0.87 |

By rolling in accordance with the method of the present invention, as above mentioned, the diameters of the grooveless rolls can be reduced to an extent of 100 mm with the aid of back up rolls, so that the ratios D/H are much smaller than in the conventional grooveless roll rolling method to improve the elongation efficiency or prevent the widening in width of rolled material as shown in FIG. 29, thereby achieving a stable rolling.

Although the above example explains the application of the method according to the present invention to a continuous finishing mill in the manufacturing of 11 m diameter round steel rods, the method can be advantageously applied to upstream passes for the purpose of reducing the sectional areas of rods other than forming passes for giving final cross-sectional shapes to products. Moreover, the method may be applied not only to continuous mills but also to single mills such as reverse mills. Although the four high mills have been exemplarily illustrated, the back up means are not essential when carrying out the method of the invention.

As can be seen from the above description, this invention is useful to stably effect the rolling steel rods and wires with grooveless rolls with high elongation efficiency to considerably improve productivity. Moreover the entry guide for use in rolling with grooveless rolls ensures that the material is held up to the exist of the roll gap to effectively prevent the troubles conventionally inherent in grooveless roll rolling, thereby obtaining effective utilization of the rolling energy and considerable improvement of product yield rates.

While the invention has been particularly shown and described with reference to preferred embodiments thereof, it will be understood by those skilled in the art that changes in form and details can be made therein without departing from the spirit and scope of the invention, as defined in the claims.

We claim:

1. A method of producing steel rods and wires by grooveless rolling obtaining high elongation efficiency and stable rolling, which method comprises passing blank material of rectangular cross-section through gaps set between pairs of grooveless rolls which form a series of continuous rolling mills, setting the gaps so that the ratio between the longer side and the shorter side of the cross-section of the blank material passing through the gaps is less than 1.5, the number of passes of the blank material wherein the aspect ratio is less than 1.5 being more than 30% of the total number of grooveless rolling passes, introducing the blank material into the gaps set between the pairs of grooveless rolls by entry guides provided at each of the rolling mills, each of the entry guides including adjustable guide rollers supporting sides of the blank material on an entrance side of the gap between the pair of grooveless rolls and a bill-like projection which extends into the gap between each pair of the pairs of grooveless rolls beyond an imaginary line connecting centers of the pairs of grooveless rolls with clearances between the blank material and inner relief surfaces of said bill-like projection in opposition to the blank material being between 1 and 5 mm, so as to prevent the blank material from twisting in conjunction with the supporting of the guide rollers at the entrance side of the gap, subjecting the blank material to reduction of the cross-sectional area thereof by the grooveless rolls under a rolling condition limiting the ratio of roll diameter D of each pair of grooveless rolls to the gap H therebetween according to the gap H and satisfying the relationship expressed by $D/H \leqq (100/H)+5$ so as to effectively restrain widening of the blank material being rolled, achieving high elongation efficiency and enabling stable grooveless rolling, and subjecting the sectionally reduced blank material to finishing caliber rolling through passes, not more than four passes and not less than two passes, so as to obtain the ultimate shape of the rods and wires.

2. A method as claimed in claim 1, further comprising supporting the side surfaces of the blank material as it is introduced into the gap between the grooveless rolls with the entry guide of each rolling mill, which entry guide further comprises, guide plates, mating with each other and having respective inner taper surfaces, a pair of holders embracing said guide plates and having guide rollers supporting the side surfaces of the blank material downstream of the taper ends of said inner taper surfaces of said guide plates, and a box-shaped guide in which said guide plates, said pair of holders, and said guide rollers are adjustably assembled, each of said holders including said bill-like projection which extends into the gap to prevent the blank material from twisting.

3. A method as claimed in claim 1, further comprising subjecting the blank material to reduction of the cross-sectional area thereof under a rolling condition limiting the roll diameter D of each pair of grooveless rolls to smaller than 360 mm $\phi$, and satisfying the relationship expressed by $D/H \leqq (100/H)+5$.

* * * * *